United States Patent [19]

Yorisue et al.

[11] Patent Number: 4,691,536

[45] Date of Patent: Sep. 8, 1987

[54] DUST REMOVING DEVICE FOR CIRCULAR KNITTING MACHINE

[75] Inventors: Shozo Yorisue, Hyogo; Seiji Morimoto, Aichi, both of Japan

[73] Assignee: Precision Fukuhara Works, Ltd., Japan

[21] Appl. No.: 894,656

[22] Filed: Aug. 7, 1986

[30] Foreign Application Priority Data

Aug. 30, 1985 [JP] Japan ..... 60-192800

[51] Int. Cl.[4] ..... D04B 35/32

[52] U.S. Cl. ..... 66/168; 15/405

[58] Field of Search ..... 15/405; 57/303, 304; 139/1 C; 66/168

[56] References Cited

U.S. PATENT DOCUMENTS

| | | | |
|---|---|---|---|
| 2,400,792 | 5/1946 | Turner | 139/1 C X. |
| 2,522,183 | 9/1950 | Lawson | 66/168 |
| 2,975,791 | 3/1961 | Pansini | 15/1.7 X |
| 3,269,151 | 8/1966 | Abrams et al. | 66/168 |
| 3,422,640 | 1/1969 | Abrams | 66/168 |
| 3,459,010 | 8/1969 | Ferri | 66/168 |
| 3,545,029 | 12/1970 | Walmsley et al. | 15/404 X |
| 3,783,648 | 1/1974 | Heinrichs | 66/168 |
| 3,897,605 | 8/1975 | Dickinson | 15/405 X |

FOREIGN PATENT DOCUMENTS 801690 9/1958 United Kingdom .

*Primary Examiner*—Wm. Carter Reynolds

*Attorney, Agent, or Firm*—Bell, Seltzer, Park & Gibson

[57] ABSTRACT

The waste fiber removing device of the present invention is provided with at least one air jet nozzle and a fluttering motion is imparted to the free outer end of the air jet nozzle so that the air is directed over a relatively wide area of the knitting machine. The air jet nozzle is either stationary or may be rotated to prevent the accumulation of lint on various adjacent parts of the knitting machine. The fluttering motion of the air jet nozzle is preferably accomplished by forming the area adjacent the free end of an elastic or other type of flexible material. Various types of adjusting devices are provided for limiting the fluttering motion of the air jet nozzle so as to vary the area of the knitting machine against which the air is directed to blow away lint and the like.

3 Claims, 11 Drawing Figures

DUST REMOVING DEVICE FOR CIRCULAR KNITTING MACHINE

FIELD OF THE INVENTION

This invention relates generally to a device for blowing away and removing dust and other waste materials, such as lint and fibers, which tend to accumulate on the various portions of a circular knitting machine, such as the yarn support creel, the sinkers, the sinker bed and cap, the knitting needles, yarn feeding devices, yarn guides, yarn breakage detecting devices and the like.

BACKGROUND OF THE INVENTION

Waste fibers, dust and lint tend to accumulate on the knitting machine parts and are occasionally knitted into the fabric causing defects in the knitted fabric and, in some cases, causing damage to the knitting needles and other parts of the knitting machine. Various types of air blowing cleaning devices have been provided for blowing away and removing the waste fibers and lint before they can accumulate to the point that they cause damage to the machine and/or the knit fabric.

These known devices usually include one or more air jet pipes or nozzles with an opening at the outer end. These air jet pipes are usually rotated in the same or opposite directions to that of the revolving needle cylinder and are normally directed to blow waste fibers from specific locations on the knitting machine.

Japanese Patent Publication No. SHO 52-33705 discloses an arrangement of air jet pipes which rotate in the opposite direction to that of the revolving needle cylinder and the open tip of the air jet pipes is located at the level of the knitting ledge of the sinkers so that the air is directed against the knitting stations surrounding the needle cylinder. The outer end portions of the rotating air jet pipes are positioned at an angle so that the air is directed in generally the direction of the revolving needle cylinder so that the air is directed generally in the same direction as that of the yarn being fed to the knitting needles. In accordance with this invention, the open tip or orifice of the air jet pipe is directed in a specific direction so that waste fiber removal is limited to a relatively narrow area of the knitting machine.

In order to clean a wider area to clean several positions on the knitting machine, a plurality of air jet pipes would be required. However, even the provision of a plurality of air jets still provides limited blowing action on particular locations of the knitting machine and still does not insure the removal of lint and the like from positions between the locations where the air jets are directed. Also, the use of a large number of air jet pipes results in a decrease in air pressure, and/or the need to substantially increase the amount of air supplied to the knitting machine. A larger number of air jet pipes also requires a more complicated mechanism for revolving the plurality of air jet pipes.

SUMMARY OF THE INVENTION

With the foregoing in mind, it is an object of the present invention to eliminate the disadvantages of the prior art and to provide a waste fiber removing air jet which is simple in construction and inexpensive to manufacture and yet operates to remove waste fibers and the like from a relatively wide area of the knitting machine.

The waste fiber removing device of the present invention is provided with at least one air jet pipe which is sufficiently flexible adjacent its outer free end for imparting a fluttering motion to the free end of the air jet so that the air jet is directed over a relatively wide area of the knitting machine as the air jet pipe is revolved to prevent the accumulation of lint on various adjacent parts of the knitting machine. The fluttering motion of the air jet pipe is preferably accomplished by forming the outer end portion of the air jet pipe of an elastic or other type of flexible material. Means is provided for adjusting the angle of the fluttering motion of the outer end of the air jet pipe so as to vary the area of the knitting machine against which the air jet is directed as the air jet pipe rotates.

The fluttering motion angle adjusting means is illustrated in several forms and serves as a restriction to limit the up and down and sidewise fluttering motion of the air jet pipe. The fluttering motion angle adjusting means is carried by a rigid portion of the air jet pipe and includes a flutter limiting member with an outer end portion completely surrounding and normally being spaced from the air jet pipe. The flutter limiting member is supported for longitudinal adjustment along the air jet pipe for varying the location longitudinally of the air jet pipe at which the outer end portion is engaged by the air jet pipe to thereby vary the amount of swinging movement of the free end of the air jet pipe. The fluttering adjustment means may be applied to air jet pipes disposed to extend from the center of the revolving cylinder and directed against the knitting parts, those air jet pipes extending from the center of the revolving needle cylinder and to the upper part of the knitting machine, or those air jet pipes positioned on the outside of the cylinder to direct an air jet against the needle cylinder or other parts of the knitting machine.

In each embodiment of the invention, when air under pressure is directed through the air jet pipe, the flexible outer end portion of the air jet pipe is subjected to an up-and-down or to-and-fro fluttering motion in a rapid and irregular manner so that lint and the like is removed from a wide area of the knitting machine as the air jet is directed against a relatively wide area of the knitting machine.

BRIEF DESCRIPTION OF THE DRAWINGS

Other objects and advantages will appear as the description proceeds when taken in connection with the accompanying drawings, in which—

DESCRIPTION OF THE ILLUSTRATED EMBODIMENTS

Figure 1:
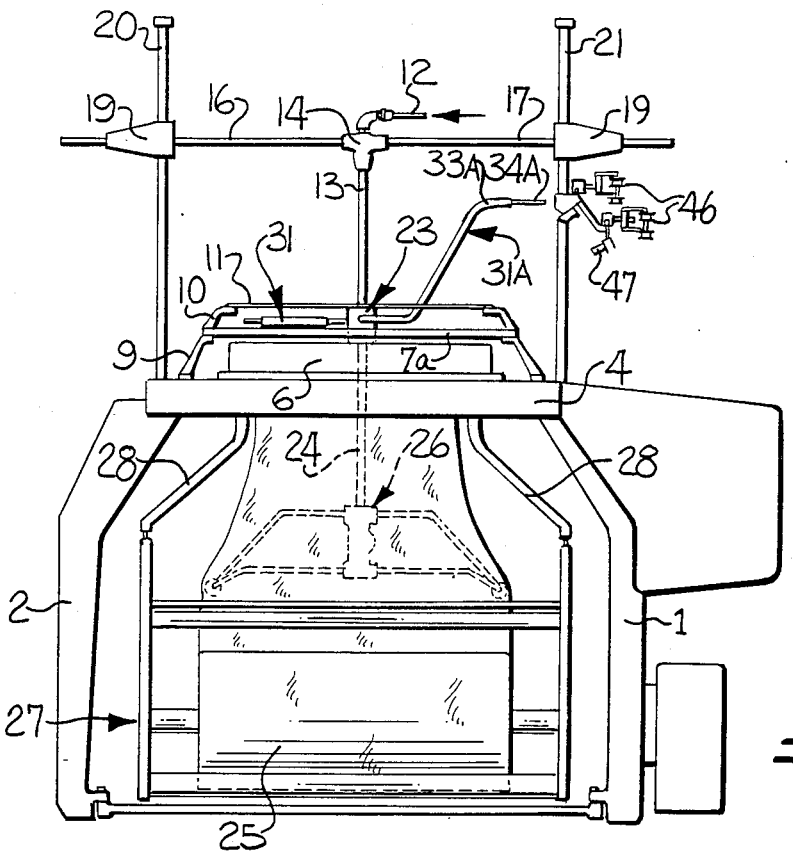
FIG. 1 is a somewhat schematic front elevational view of a circular knitting machine with the dust removing device of the present invention applied thereto.
Figure 2:
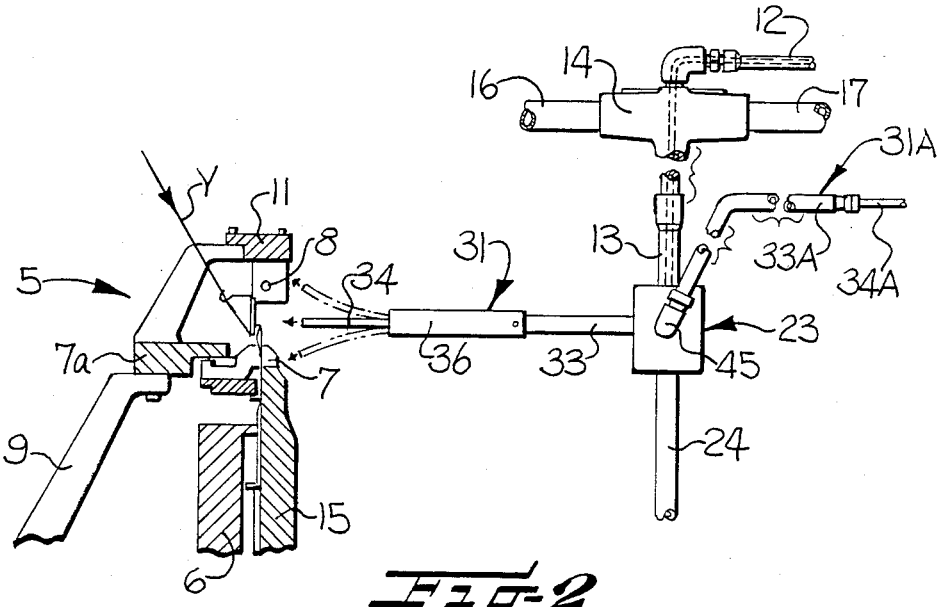
FIG. 2 is an enlarged vertical sectional view through the upper portion of the needle cylinder and illustrating the fluttering air jet pipe being used to remove lint from a wide area in the knitting plane.
Figure 3:
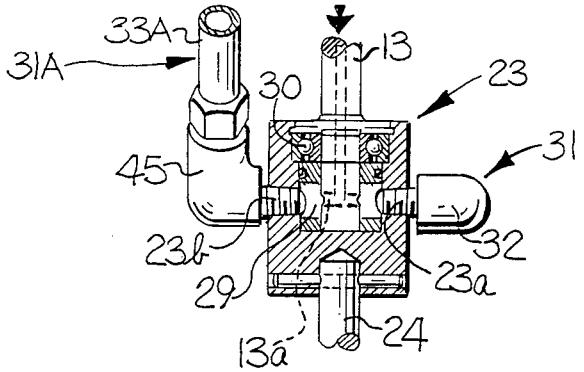
FIG. 3 is a vertical sectional view through the bearing housing of the rotating air jet device.

As illustrated in FIG. 1, the circular knitting machine includes a main bed plate 4 supported on the upper ends of legs 1, 2 and supporting a stitch cam ring 6, surrounding a rotatable needle cylinder 15 (FIG. 2). A plurality of knitting stations, broadly indicated at 5 in FIG. 2, is positioned in spaced-apart relationship around the circular knitting machine.

As illustrated in FIG. 2, each of the knitting stations 5 includes suitable needle cams, not shown, supported in the cam ring 6, and a yarn carrier 8 for feeding yarn Y to the knitting needles for forming fabric therefrom in cooperation with radially movable sinkers 7. The knitting needles are supported for vertical sliding movement in the usual needle grooves formed on the outer circumference of the rotating needle cylinder 15. The needle cylinder 15 is rotated in the usual manner by a ring gear, not shown, supported in the main bed plate 4. The sinkers 7 are supported for radial movement in a sinker dial carried by the needle cylinder 15 and the radial position of the sinkers is controlled by the usual cams in a sinker cap ring 7*a* supported in a fixed position on the upper ends of radially extending and spaced apart support arms 9 with the lower portions thereof being fixed on the main bed plate 4.

The yarn feed fingers 8 are supported on a yarn carrier ring 11 which is in turn supported on the upper ends of support arms 10 having their lower ends fixed on the sinker cap ring 7*a*.

The upper end of a vertically extending fixed air supply pipe 13 is supported in a support joint 14 and extends downwardly in the center of the needle cylinder 15. The upper end of the air supply line 13 is connected to a suitable source of compressed air, not shown, as by a supply line 12, so that air under pressure is directed downwardly through the fixed supply pipe 13. The lower end of the fixed air pressure pipe 13 is rotatably attached to the upper end of a bearing housing, broadly indicated at 23 (FIGS. 2–6). As will be noted in FIG. 2, the vertical position of the central portion of the bearing housing 23 is substantially the same or slightly higher than the upper end of the rotating needle cylinder 15. The support joint 14 is supported by radially extending horizontal connector rods 16, 17, and the outer ends are connected by support brackets 19 to the upper end portions of support posts 20, 21, the lower ends of which are fixed on the bed plate 4 (FIG. 1).

The upper end of a driving and rotating shaft 24 is fixed in the lower portion of the bearing housing 23. The lower end of the rotating shaft 24 is fixed to a knit fabric spreader unit, broadly indicated at 26 in FIG. 1, for moving the circular fabric into a flattened condition to be wound onto a fabric take-up roll 25, in the usual manner. The spreader unit 26 forms a part of a take-up unit, broadly indicated at 27. The take-up unit 27 and the spreader 26 are rotated by means of connecting rods or arms 28, the upper ends of which are fixed to the rotating gear for the needle cylinder 15, in the usual manner.

The lower end of the air supply pipe 13 extends through a bearing 30 supported in the upper end of the bearing housing 23 and into an annular air distribution groove 29 surrounding the lower end of the air supply pipe 13. Radial openings direct the air from the center of the air supply pipe 13 and into the annular air supply groove 29. The radially extending air passageway openings are indicated in dotted lines at 13*a* in FIG. 4.

Figure 4:
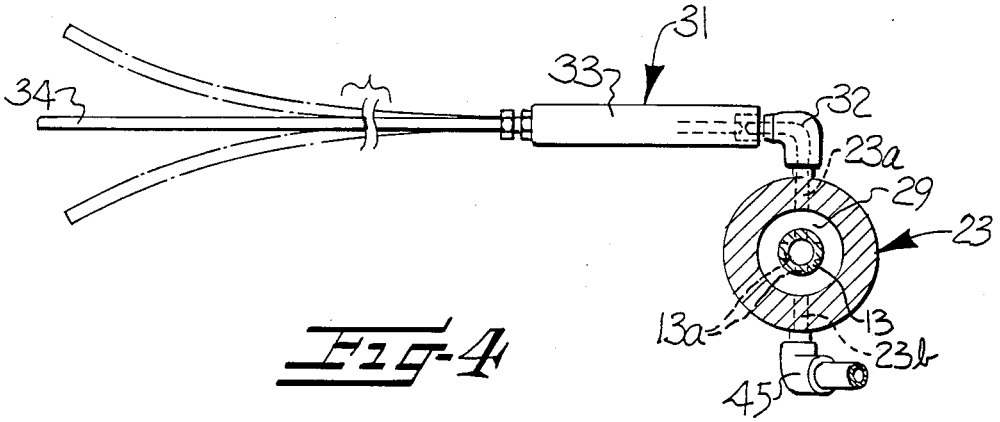
FIG. 4 is a plan view of one type of air jet nozzle, and with the bearing housing being shown in cross section.

As shown in FIG. 4, the bearing housing 23 is provided with an air opening passageway 23*a* at one side thereof and a first air jet pipe elbow 32 is communicatively connected thereto and supports the inner end of a first air jet pipe, broadly indicated at 31. The first air jet pipe 31 includes a rigid intermediate pipe section 33, formed of a nonelastic material, such as metal or plastic, and extending horizontally from the elbow 32 and toward the inner periphery of the needle cylinder 15. A flexible or elastic nozzle section 34, of smaller diameter than the intermediate pipe section 33, is connected at its inner end to the rigid intermediate nozzle section 33 and its outer end is provided with an outlet opening for directing an air jet toward the successive needle knitting stations 5 as the bearing housing 23 and the air jet device 31 are rotated. The jetting of the air stream from the free end of the flexible nozzle 34 imparts a fluttering motion to the outer end portion thereof so that it is moved in a rapid and irregular manner in a horizontal and/or vertical plane, as illustrated in dash-dot lines in FIGS. 2 and 4. Thus, the air for cleaning and removing lint and the like is spread over a relatively wide area of the knitting machine, rather than being directed in a single relatively narrow path of travel, as is the case with the prior art air cleaning devices.

The fluttering motion imparted to the nozzle 34 and the resulting swing angle of the outer end thereof is influenced by the amount of air pressure introduced into the nozzle 34 and escaping from the outer end thereof, the thickness and rigidity of the nozzle 34, the weight of the open free end, and/or the length of the exposed or unrestricted portion of the nozzle 34. These factors can be changed to change the fluttering motion imparted to the nozzle 34, depending upon the desired area of the machine to be cleaned by directing air upon the knitting machine.

Figure 5:
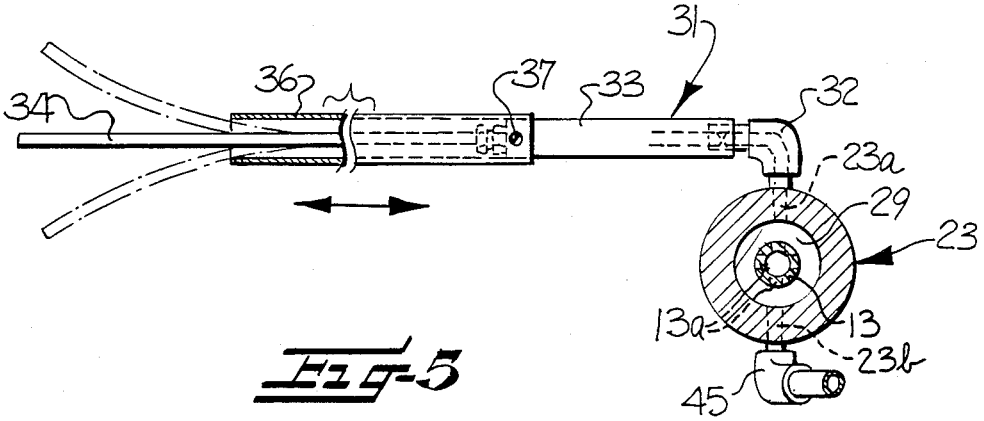
FIG. 5 is a view similar to FIG. 4 but showing one type of fluttering adjustment device applied to the air jet pipe.

Several different embodiments are illustrated for adjusting or varying the fluttering motion of the nozzle 34. An adjustment device is illustrated in FIG. 5 in the form of an intermediate pipe extension 36 having its inner end supported for longitudinal adjustment along the intermediate pipe section 33 by an adjustment set screw 37. The inner peripheral surface of the outer free end of the adjustment pipe 36 is larger than the outer diameter of the nozzle 34 and defines a flutter limiting member surrounding and normally being spaced from the nozzle 34. The fluttering movement of the tip or free end of the nozzle 34 can be varied by sliding the adjustment tube 36 inwardly to increase the swinging angle and by sliding the adjustment pipe 36 outwardly to decrease the amount of fluttering motion imparted to the flexible nozzle 34.

Figure 6:
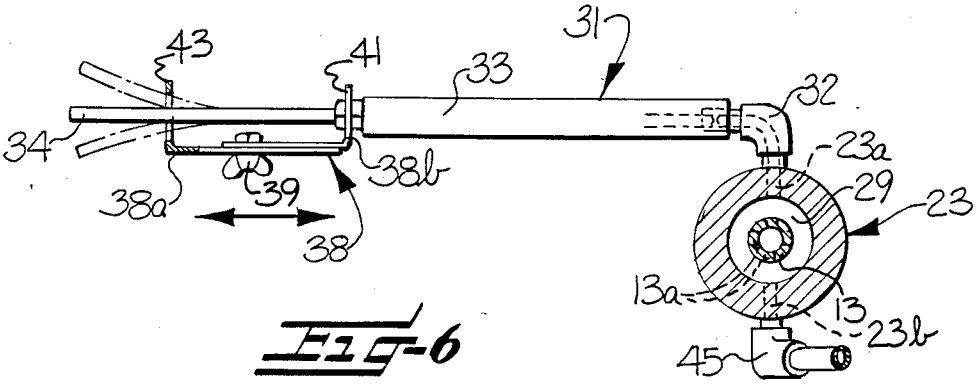
FIG. 6 is a view similar to FIGS. 4 and 5 but illustrating another type of air jet flutter adjusting device applied thereto.
Figure 7:
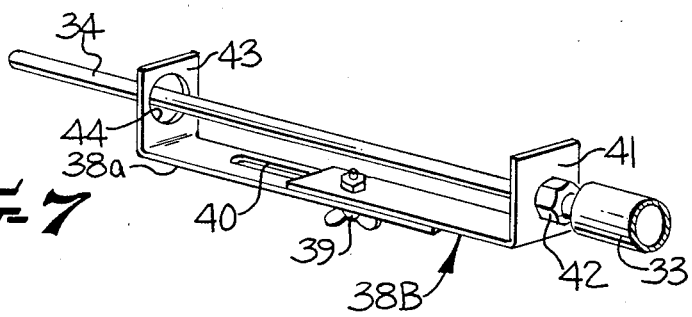
FIG. 7 is an enlarged perspective view illustrating the type of fluttering adjustment device shown in FIG. 6.

A flutter adjusting device, broadly indicated at 38, is illustrated in FIGS. 6 and 7 and includes L-shaped plate members 38*a* and 38*b* which have overlapping horizontal legs. A vertical leg 41 of the plate member 38*b* is fixed to the juncture of the rigid intermediate pipe 33 and the inner end of the flexible nozzle 34, as by nuts 42. The horizontal leg of the L-shaped plate member 38*a* is provided with an elongate slot 40 for reception of a locking nut fixed in the horizontal leg of the plate 38*b* and secured in adjusted position by a wing nut 39. The vertical leg 43 of the L-shaped plate member 38*a* is provided with an enlarged opening 44 defining a flutter limiting member on the outer end portion of the flutter adjusting device 38. The opening 44 completely surrounds and is normally spaced from the flexible nozzle 34 so that the opening 44 acts to limit the fluttering motion imparted to the flexible nozzle 34 by the air pressure extending through and jetting out of the free end of the air nozzle 34. By adjusting the length of the adjustment device 38, the length of the exposed part of the flexible nozzle 34 extending from the front side of the vertical leg 43 to the open free end can be adjusted to thereby adjust the amount of fluttering motion imparted to the flexible nozzle 34.

Figure 8:
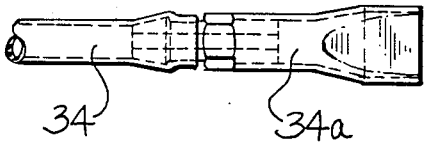
FIG. 8 is an elevational view of the outer tip portion of a modified type of air jet pipe which may be used in accordance with the present invention.

As illustrated in FIG. 8, the free end of the flexible nozzle 34 is preferably provided with a fixture 34*a* which provides a flat or elongated opening for the escape of the air through an elongate air jet orifice as it is directed against the desired parts of the knitting machine.

Figure 10:
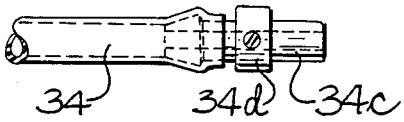
FIG. 10 is an elevational view of the outer tip portion of another type of air jet pipe which may be used in accordance with the present invention.

As illustrated in FIG. 10, the outer free end portion of the flexible nozzle 34 is provided with a fitting 34*c*, on which a metal ring weight member 34*d* is supported for longitudinal adjustment to thereby vary the weight of the outer end portion of the flexible nozzle 34. Adjustment of the ring weight 34*d* inwardly or outwardly varies the amount of fluttering motion imparted to the outer free end of the flexible nozzle 34.

The lint removal device thus far described is particularly adapted to be positioned for rotation inside of the needle cylinder 15 and for removing lint and dust from the portions of the knitting machine adjacent each of the successive knitting stations 5 with each rotation of the bearing member 23. In accordance with the present invention, it is also possible to remove lint and dust from certain areas on the upper portion of the knitting machine by air pressure directed outwardly from the center of the needle cylinder for cleaning the upper portions of the knitting machine. To this end, an elbow 45 is fixed in the bearing housing 23 and communicates with an air passageway 23*b*. The inner end of a rigid intermediate pipe section 33A is connected to the elbow 45 and forms a part of a second air jet pipe, broadly indicated at 31A.

Figure 9:
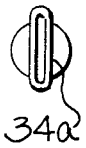
FIG. 9 is an end elevational view of FIG. 8.

As illustrated in FIGS. 1 and 2, a flexible nozzle 34A is connected to the rigid intermediate pipe 33A and also has a fluttering motion imparted thereto by air pressure being directed out of the free tip end thereof to remove and clean lint and the like from a relatively wide area of the upper portions of the knitting machine, such as the rotating tape yarn feed device, schematically illustrated at 46 in FIG. 1, and the yarn breakage detecting devices 47 positioned above each of the knitting stations 5. The second air jet cleaning device 31A for blowing lint from the upper portions of the knitting machine can also be provided with any of the disclosed different types of fluttering motion limiting or adjusting devices illustrated in FIGS. 5, 6, 7 or 10. The outer free end of the flexible nozzle 34A may also be provided with an elongate or flat air jet opening of the type illustrated in FIGS. 8 and 9.

Figure 11:
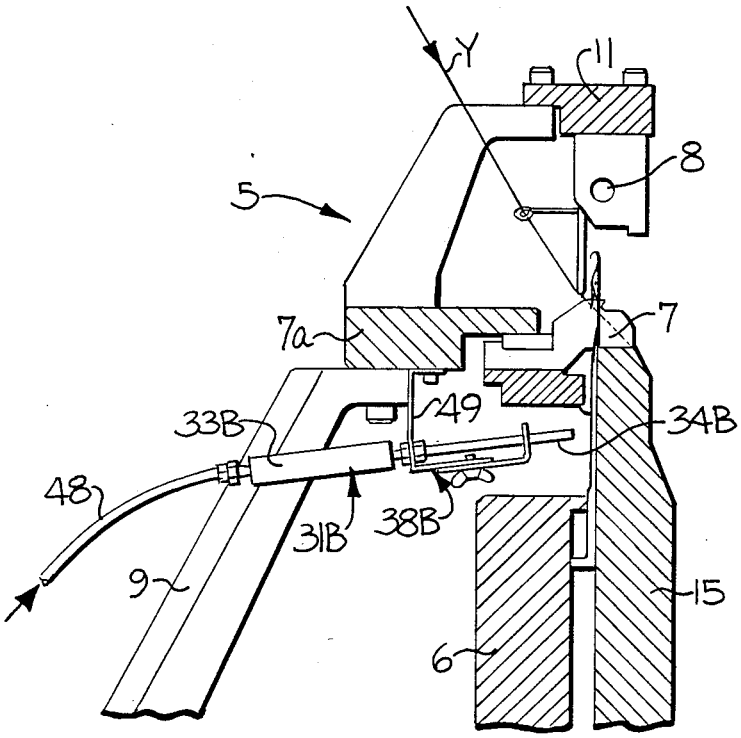
FIG. 11 is a vertical sectional view through the upper portion of the needle cylinder and illustrating a fluttering air jet nozzle supported on the outside of the revolving needle cylinder for directing a lint removing air jet against the outer periphery of the needle cylinder.

It is also possible, in accordance with the present invention, to provide a fluttering air jet positioned to direct a lint blowing and cleaning air jet inwardly against outer portions of the knitting machine, as well as directing the fluttering air jet outwardly from the center of the knitting machine, as described in the embodiments thus far described. Such an arrangement is illustrated in FIG. 11 where the compressed air from the compressed air source, not shown, is directed through a pipe 48 and into and through an air jet pipe, broadly indicated at 31B. The air jet pipe 31B includes a rigid intermediate pipe 33B and an air jet nozzle 34B. In this instance, the air jet pipe 31B is supported by a bracket 49 extending downwardly from and secured to the sinker cap ring 7*a* so that the air is directed against the outside of the needle cylinder 15 and in the area of each knitting station 5. The swinging angle of the flexible fluttering nozzle 34B is illustrated as being adjustable by an adjustment bracket 38B, of the type shown in FIG. 7 so that the area against which the air jet is directed on the rotating needle cylinder 15 may be varied as desired.

Thus, the lint removing device of the present invention includes a fluttering air jet nozzle which moves in a rapid and irregular manner to blow lint and the like from a relatively wide area of the knitting machine as the fluttering air jet is directed toward various locations of the knitting machine. Various embodiments are illustrated for adjusting the amount of flutter which may be imparted to the fluttering air jet nozzle so as to direct the cleaning air jet against the parts of the knitting machine from which the lint and fibers are to be removed. The dust, lint and fiber removing device is simple in construction and is effective for cleaning lint and fibers from the machine while conserving the amount of pressurized air required in the cleaning operation.

In the drawings and specification there have been set forth the best modes presently contemplated for the practice of the present invention, and although specific terms are employed, they are used in a generic and descriptive sense only and not for purposes of limitation, the scope of the invention being defined in the claims.

That which is claimed is:

1. A lint removing device for a circular knitting machine including an air jet nozzle having a free open end forming an orifice, means carried by said knitting machine and supporting said air jet nozzle for directing air against an area of said knitting machine adjacent said open end orifice of said air jet nozzle for blowing lint and dust from the portion of said knitting machine adjacent said air jet nozzle, means for supplying air under pressure to said air jet nozzle, means for causing said air jet nozzle to move with a fluttering motion to thereby increase the area of the knitting machine being engaged by the air being ejected from said air jet nozzle orifice, and fluttering motion adjustment means for limiting the swinging movement of said free open end of said air jet nozzle, said fluttering motion adjustment means comprising a flutter limiting member including an outer end portion completely surrounding and normally being spaced from said air jet nozzle, and means supporting said outer end portion of said flutter limiting member for longitudinal adjustment along said air jet nozzle for varying the location longitudinally of said nozzle at which said outer end portion is engaged by said nozzle to thereby vary the amount of swinging movement of said free open end of said air jet nozzle.

2. A lint removing device according to claim 1 wherein said flutter limiting member comprises a flutter adjusting pipe having an internal diameter larger than the external diameter of said air jet nozzle, said outer end portion comprising said internal diameter at the outer end of said pipe.

3. A lint removing device according to claim 1 wherein said flutter limiting member comprises a pair of L-shaped plate members including overlapping horizontal legs and opposed vertical legs, means connecting together said horizontal legs for longitudinal adjustment relative to each other, one of said plate members being fixed relative to said air jet nozzle, and said other of said plate members having a hole in the vertical leg thereof which is larger than the outer diameter of said air jet nozzle, said hole defining said outer end portion of said flutter limiting member and being engageable by said air jet nozzle to limit fluttering motion thereof.

* * * * *